United States Patent [19]

Uthoff, Jr.

[11] Patent Number: 4,779,590

[45] Date of Patent: Oct. 25, 1988

[54] ENGINE THROTTLE CONTROL WITH LOW IDLE SPEED ACTUATION FORCE

[75] Inventor: Loren H. Uthoff, Jr., Canton, Mich.

[73] Assignee: Eaton Corporation, Cleveland, Ohio

[21] Appl. No.: 12,600

[22] Filed: Feb. 6, 1987

[51] Int. Cl.[4] ..... F02D 9/08; F02M 3/12

[52] U.S. Cl. ..... 123/339; 123/337

[58] Field of Search ..... 123/336, 337, 339, 403; 261/63, 65

[56] References Cited

U.S. PATENT DOCUMENTS

| | | | |
|---|---|---|---|
| 1,130,103 | 3/1915 | Plumm | 123/337 |
| 3,620,195 | 11/1971 | Lamm | 123/337 |
| 3,934,851 | 1/1976 | Illing | 123/336 |
| 4,408,581 | 10/1983 | Pfalzgraf et al. | 123/339 |
| 4,519,369 | 5/1985 | Kitamura | 123/337 |

*Primary Examiner*—Willis R. Wolfe

*Attorney, Agent, or Firm*—J. G. Lewis

[57] ABSTRACT

An air throttle (10) for an internal combustion engine has a butterfly-vane (16) mounted for rotation in the engine charge air inlet (15). The butterfly-vane is mounted on a rigid tubular shaft (18) having an idle air bleed slot (22) therethrough with a tubular idle valve (24) slip fit within the shaft for concentric rotation therein. With the butterfly-vane closed for idle mode running, the idle valve is rotated between set limits established by abutment surfaces (26) and (36) defined by slot (25) to control idle air flow and idle speed. Upon rotation of the idle valve beyond the set limits, the butterfly-vane is progressively opened for off-idle mode running speed control.

12 Claims, 2 Drawing Sheets

ENGINE THROTTLE CONTROL WITH LOW IDLE SPEED ACTUATION FORCE

CROSS-REFERENCE TO RELATED APPLICATION

The present invention represents an improvement of the invention disclosed and claimed in application Ser. No. 884,140 filed July 10, 1986, still pending.

BACKGROUND OF THE INVENTION

The present invention relates to air throttling for the charge air inlet of an internal combustion engine, where it is common practice to provide a butterfly-type vane rotatably disposed in the throttling passage of the engine charge air inlet. Representative prior art approaches are illustrated in U.S. Pat. Nos. 1,130,103 and 2,796,082. Butterfly-vane type air throttles provide responsive and effective valving of the engine charge air for off-idle engine operation requiring part or fully open throttle. However, in idle operation requiring substantially closed throttle, the butterfly-vane type air throttle has the disadvantage that an extremely small movement of the throttle vane produces drastic changes in engine speed. Consequently, it has been the practice in engine design to provide only fixed speed engine idle control by adjustment of a stop limit for maintaining the butterfly-vane throttle "cracked" or opened only a very small amount from the fully closed position during engine idle conditions.

However, in order to provide adequate charge air to the engine inlet when idle speed load conditions change, the butterfly throttle vane must be moved to vary the flow of charge air to the engine inlet. For example, when the vehicle air conditioner is cycled at idle, the substantial change in engine load requires a compensating throttle change. However, it has been found difficult to provide a vehicle operator adjustable idle speed control. Presently, it is the practice to provide a solenoid operated step for the fixed adjustment for closed throttle limit stop. The solenoid, when actuated, positions a "fast idle" cam under the closed throttle position adjustment screw for holding the throttle open a slight additional amount to increase engine idle speed.

It has, however, been desired to provide a way or means for varying the engine charge air flow in order to maintain a constant idle speed either by vehicle operator control or by automatic electric control. In particular, where engine fuel injection is controlled electrically by a microprocessor on board the vehicle, in order to control combustion to minimize engine emissions, it has been desired to provide a way or means of electrically varying the engine idle speed to provide the most efficient combustion at idle and also to accommodate changes in accessory load on the engine while running in the idle mode.

A further problem arises in providing a precisely controllable idle bypass flow with a device having sufficient structural integrity to reliably operate within typical engine charge air inlet conditions while exhibiting low cost and actuation power requirements.

SUMMARY OF THE INVENTION

The present invention provides precision controllable air throttling of an engine for control of the running speed at engine idle mode of operation. The present invention employs a butterfly-vane type primary throttling valve mounted on a tubular hub disposed for rotation about an axis transverse to the direction of air flow in the engine inlet. The valve and hub define an idle flow passageway for permitting charge airflow therethrough when the butterfly-vane is in the closed position. An idle speed throttling valve is provided in the form of an idle speed control member disposed concentrically within the valve hub which is rotatable with respect to the butterfly-vane and hub for valving the idle flow passageway for engine speed control in the idle mode with the butterfly-vane closed.

The idle speed control member is tubular and has an elongated slot formed therein which is of sufficient axial dimension to permit the disc shaped butterfly-valve to extend radially therethrough. The slot is dimensioned circumferentially to provide a predetermined degree of relative rotational freedom with the hub. At a particular set limit, a step in the edge of the slot contacts the butterfly-vane and causes the butterfly-vane to open upon further rotation of the idle speed control member. The idle flow passageway consists of relatively small axially aligned openings in the valve hub and butterfly-vane. The present invention thus provides idle speed control of the engine by regulating the flow of air through an idle flow passage within the main throttle valve, employing rugged construction and a sensitive control elements driven by a single actuator.

DETAILED DESCRIPTION

Figure 1:
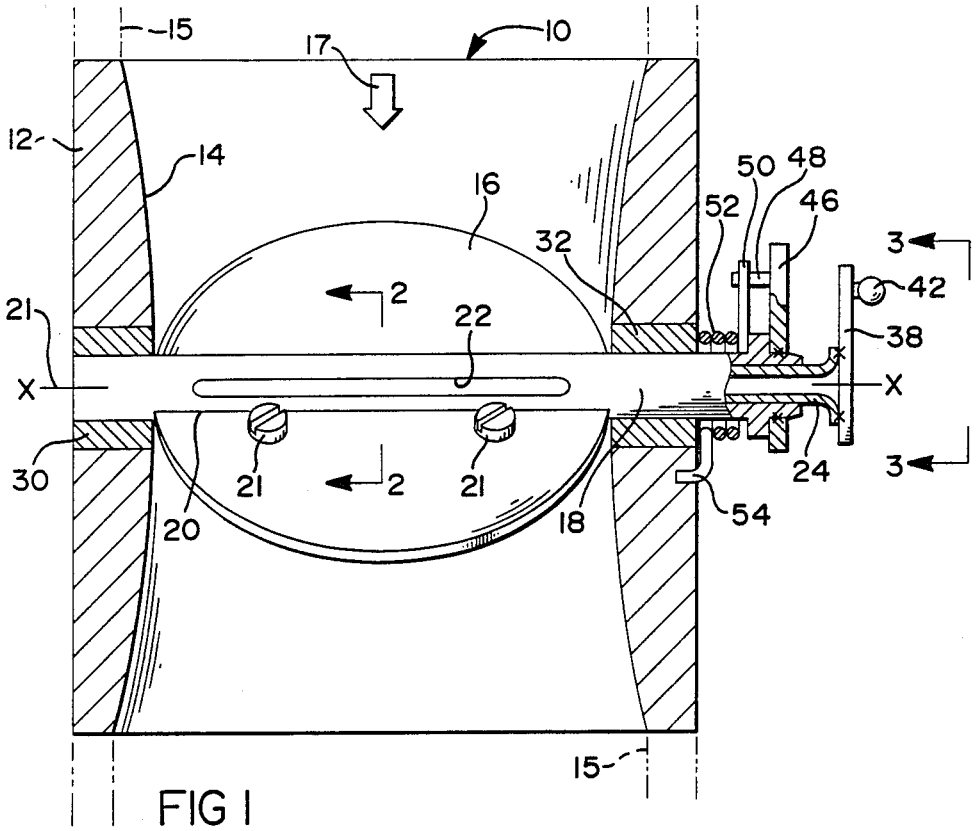
FIG. 1, is a longitudinal section through the charge air inlet passage of an engine throttle body.

Referring now to FIG. 1, the throttle of the present invention is indicated generally at 10, and has a throttle body 12 with a venturi passage 14 formed there-throttle through for flow of engine charge air therethrough to the engine inlet passage, indicated in phantom at 15, in the direction indicated by the arrow 17. Although passage 14 is shown as a venturi, a straight-walled or other type passage may be employed if desired. A suitable butterfly-vane 16 is disposed in passage 14 and is shown in the closed position in FIG. 1.

The butterfly-vane 16 is rotatable about the axis X—X, designated 21, which extends through the venturi throat in a direction transverse to the flow. The butterfly-vane 16 is attached to a hub or shaft 18, which is journaled for rotation in the throttle body as will hereinafter be described.

Figure 2A:
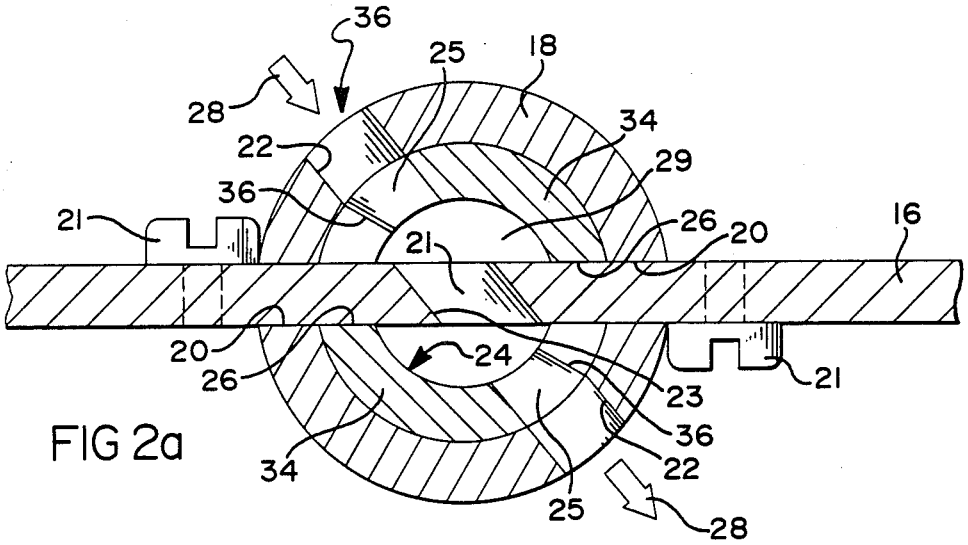
FIG. 2*a* is a section view on enlarged scale taken along section-indicating lines II—II of FIG. 1.
Figure 2B:
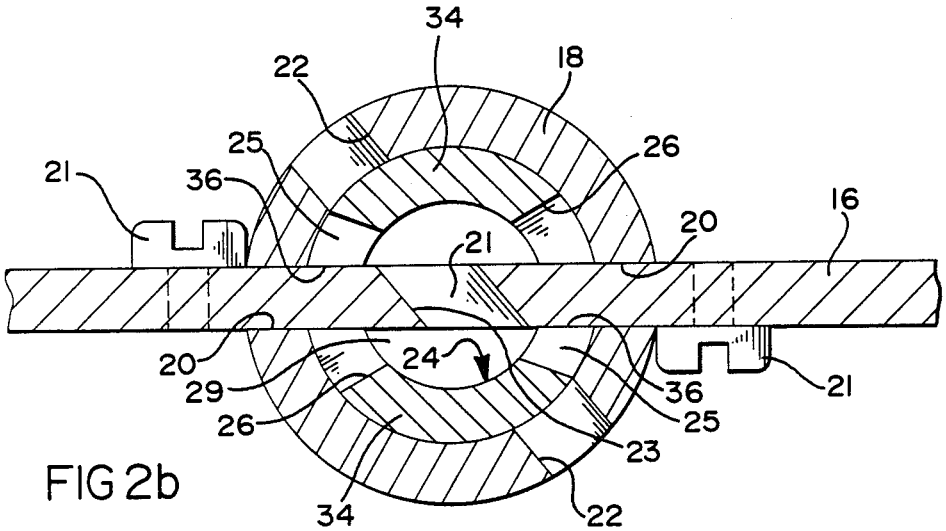
FIG. 2*b* is similar to FIG. 2*a*, and shows the idle valve in the closed position.

Referring to FIGS. 1, 2*a* and 2*b*, in the presently preferred practice, the vane is received through slots, denoted by the reference numeral 20 formed through the hub 18, and, the vane 16 is retained in assembly therewith by any suitable fastening expedient, such as screws 21, staking or other means which retains the hub and vane in the indicated position without intruding radially inwardly of the inside diameter of hub 18.

The hub 18 and vane 16 have relatively small idle flow passageways 22 and 23, respectively, therethrough which permit the flow of charge inlet air through the venturi when the butterfly-vane 16 is in the substantially closed position in the passage 14. A tubular idle valve shaft member 24 is slip fit within hub 18 for concentric rotation with respect thereto. The member 24 has two symmetrical slots, designated generally at 25, extending axially sufficiently to allow butterfly-vane 16 to pass radially therethrough without interference. As can be best seen in FIGS. *2a, 2b* and 4, slots 25 are circumferentially dimensioned to permit a range of relative rotational freedom of approximately 30 degrees between the positions illustrated in FIGS. *2a* and *2b*. Small extensions or steps 35 are formed by slots 25 that extend axially inwardly, forming abutment surfaces 36. Dimensionally, slots 25 extend axially (designated $D_S$) beyond of the axial extent (designated $D_V$ in phantom) of vane 16 which, in turn, exceeds the axial separation of steps 35 (designated ($D_O$). In other words, $D_S \geqq D_V \geqq D_O$. Slots 25 form part of the idle flow passageway, illustrated generally by arrows 28 in FIG. *2a* as well as abutment surfaces 26 and 36 for contacting butterfly-vane 16 for opening the butterfly valve upon further rotation of member 24, and upon closure of member 24, respectively. Flow passage 36 thus comprises passageways 22 and 23, slots 25 and the volume, designated 29 within the inside diameter of member 24. Member 24 can be sealed at both ends to prevent communication with the atmosphere. Hub 18 is journaled at its ends in bearings 30 and 32 provided in the throttle body for rotation therein.

Referring now to FIGS. 1, *2a* and *2b*, member 24 has arcuately shaped valving portions 34 which are shown in FIG. *2a* rotated to a position fully opening idle flow passageway 36. In FIG. *2b*, member 24 has been rotated counterclockwise approximately 30 degrees to a position wherein abutment surfaces 36 are contacting vane 16 and valving portions 34 close idle flow passageway 36 by covering passageways 22.

Figure 3:
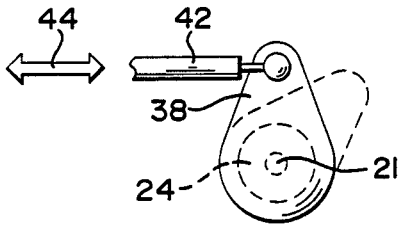
FIG. 3 is a view taken along section-indicating line III—III of FIG. 1.
Figure 4:
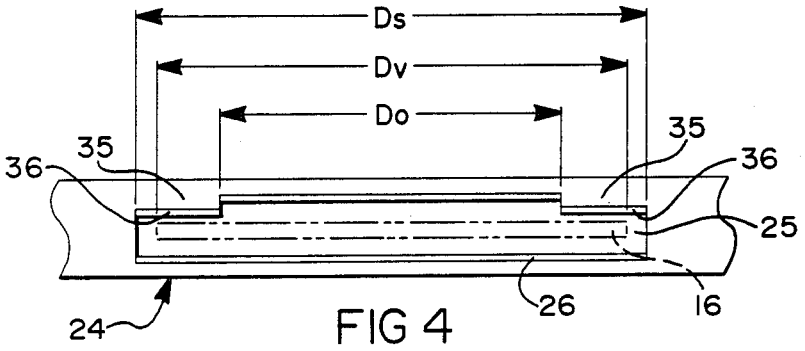
FIG. 4 is a perspective view of the idle valve member of FIG. 1 on an enlarged scale.

Referring to FIGS. 1 and 3, the member 24 extends outwardly from the throttle bearing 32 at one end thereof, and has attached for effecting rotation thereof a crank member 38 having a control actuator member 42 through an aperture provided through the crank member 38. The control actuator member 42 is reciprocated by a suitable power mechanism (not shown) in the directions indicated by the double arrow 44 shown in FIG. 3.

Hub 18 also extends outwardly beyond the end of bearing 32 and is joined to a crank member 46 such as by welding. Crank member 46 has an axially inwardly directed pin 48 which contacts one end 50 of a coil spring 52 concentrically disposed about shafts 18 and 24. The other end 54 of spring 52 is likewise attached to housing 12 of throttle body and tends to continuously bias butterfly-vane 16 and hub 18 and member 24 toward the closed position illustrated in FIG. 1. Thus, the present invention enables an automatic actuating mechanism, such as an electronic servo motor (not shown) to drive idle valve member 24 to provide continuous engine control in the idle mode with the main throttle 16 closed, and, upon movement of the idle valve member 24 beyond a predetermined position, as illustrated in FIG. *2a*, fully opening the idle flow passage 36, the main throttle vane 16 is open for off-idle engine speed control.

Referring to FIG. 3, crank member 38 is illustrated in solid line to correspond with the relative positions of hub 18 and member 24 shown in FIG. *2a*, i.e. idle flow passageway is fully open against the spring 52. As member 42 moves to the right, crank member rotates clockwise until valving portions 34 close passage 36 as illustrated in FIG. *2b*. When crank member 38 is moved counterclockwise from the position indicated in solid line in FIG. 3, butterfly-vane 16 begins to rotate in conjunction with member 24, thereby opening throttle 10 against the effect of spring 52.

The applicant has found that the foregoing structure negates any flexure of the hub due to the relatively large air forces acting upon the butterfly-vane, thereby eliminating any tendency to bind with member 24 allowing a reduction in the strength of the spring 52 and the power of the actuator required to drive idle valve member 24. Accordingly, member 24 can be reduced in size and can be controlled very precisely.

Although the invention has hereinabove been described with respect to the illustrated embodiment, it is understood that the invention is capable of modification and variation, and is limited only by the following claims.

I claim:

1. A throttle valve assembly for the charge air inlet passage of an internal combustion engine comprising:

housing means defining a portion of said inlet passage;

valve means carried by said housing means within said passage portion for rotation about an axis transverse to the direction of flow in said passage to effect modulation of said flow, said valve means comprising a generally tubular hub portion concentric to said axis, a generally circular disc throttle member extending through said hub portion for rotation therewith, and an idle flow passageway extending radially through said hub portion for directly communicating an upstream portion of said passage with a downstream portion of said passage; and a generally tubular idle speed control member mounted for concentric rotation about said axis within said hub portion to effect modulation of fluid flow through said idle flow passageway.

2. The throttle valve assembly of claim 1, wherein said throttle valve member is displaceable between a first position in which said passage is substantially closed and a second position in which said passage is substantially unobstructed, and wherein said idle speed control member is operable to modulate fluid flow through said idle flow passageway only when said throttle valve member is in said first position.

3. The throttle valve assembly of claim 2, further comprising actuator means drivingly engaging said throttle valve member to effect the rotational position thereof as a function of a control input.

4. The throttle valve assembly of claim 1, wherein said idle speed control member is operable for rotation within predetermined limits to modulate said idle fluid flow when said valve means is positioned to substantially close said inlet passage.

5. The throttle valve assembly of claim 4, wherein said idle speed control member is further operable to drivingly engage said valve means when said predetermined rotational limits are exceeded to reposition said valve means.

6. The throttle valve assembly of claim 5, further comprising means operative to bias said valve means toward said substantially closed position.

7. The throttle valve assembly of claim 1, wherein said hub portion extends axially in both directions beyond said throttle valve member within said housing means said axial extentions defining bearing surfaces on the outer diameter thereof.

8. The throttle valve assembly of claim 1, wherein said control member includes an elongated slot dimensioned in the axial direction whereby said disc extends freely radially therethrough and dimensioned circumferentially whereby said hub portion and idle speed control member have a predetermined degree of relative rotational freedom.

9. The throttle valve assembly of claim 1, wherein said idle flow passageway is axially elongated.

10. The throttle valve assembly of claim 1, wherein said idle flow passageway extends axially substantially across the entire transverse dimension of said inlet passage.

11. A throttle valve assembly for the charge air inlet passage of an internal combustion engine comprising:

housing means defining a portion of said inlet passage;

valve means carried by said housing means within said passage portion for rotation about an axis transverse to the direction of flow in said passage to effect modulation of said flow, said valve means comprising a generally tubular hub portion concentric to said axis, a throttle valve member disposed for rotation with said hub portion, and an idle flow passageway for communicating an upstream portion of said passage with a downstream portion of said passage; and an idle speed control member mounted for concentric rotation about said axis within said hub portion to effect modulation of fluid flow through said idle flow passageway, said hub portion comprising an elongated sleeve member and said throttle valve member comprising a generally circular disc extending through said sleeve member and retained in assembly therewith by fastener means disposed adjacently externally of said sleeve member.

12. The throttle valve assembly of claim 11, wherein said idle speed control member comprises an elongated slotted tube disposed within said sleeve member, said tube slot dimensioned in the axial direction whereby said disc extends freely radially therethrough and dimensioned circumferentially whereby said sleeve member and tube have a predetermined degree of relative rotational freedom.

* * * * *